US012497234B2

(12) United States Patent
DeGraaf et al.

(10) Patent No.: US 12,497,234 B2
(45) Date of Patent: Dec. 16, 2025

(54) APPARATUS, SYSTEM AND METHOD FOR MODULAR MANUFACTURE

(71) Applicant: JABIL INC., St. Petersburg, FL (US)

(72) Inventors: Gerald DeGraaf, St. Petersburg, FL (US); Jordan DeGraaf, St. Petersburg, FL (US)

(73) Assignee: JABIL INC.

( * ) Notice: Subject to any disclaimer, the term of this patent is extended or adjusted under 35 U.S.C. 154(b) by 468 days.

(21) Appl. No.: 17/417,404

(22) PCT Filed: Jan. 17, 2020

(86) PCT No.: PCT/US2020/014038
§ 371 (c)(1),
(2) Date: Jun. 23, 2021

(87) PCT Pub. No.: WO2020/150578
PCT Pub. Date: Jul. 23, 2020

(65) Prior Publication Data
US 2022/0073266 A1 Mar. 10, 2022

Related U.S. Application Data

(60) Provisional application No. 62/793,624, filed on Jan. 17, 2019.

(51) Int. Cl.
*D06F 34/34* (2020.01)
*B65D 85/68* (2006.01)
*D06F 34/05* (2020.01)

(52) U.S. Cl.
CPC ..... *B65D 85/68* (2013.01); *D06F 34/05* (2020.02); *B65D 2585/6855* (2013.01)

(58) Field of Classification Search
CPC ..... D06F 34/00; D06F 34/04; D06F 34/05; D06F 34/08; D06F 34/28; D06F 34/30; D06F 34/34
See application file for complete search history.

(56) References Cited

U.S. PATENT DOCUMENTS 2,823,661 A 2/1958 Grannan
2005/0183469 A1* 8/2005 Kang ..... D06F 39/12 68/3 R (Continued)

FOREIGN PATENT DOCUMENTS

CN 1966816 5/2007
CN 101878496 11/2010

(Continued)

OTHER PUBLICATIONS

Machine Translation of Lee, KR-20130044609-A, May 2013. (Year: 2013).*

(Continued)

*Primary Examiner* — David G Cormier
(74) *Attorney, Agent, or Firm* — Riverside Law LLP

(57) ABSTRACT

The disclosure is of and includes at least an apparatus, system and method for modular manufacturing. The apparatus, system and method may include at least a device shell capable of providing at least the structure of a manufactured device, wherein the device shell comprises a plurality of receivers; a plurality of modules, each comprising a plurality of components suitable, in combination, to provide functional aspects to the manufactured device; a plurality of connectors externally associated with each of the plurality of modules, wherein the plurality of connectors are capable of being respectively received by ones of the plurality of receivers to thereby fasten each of the plurality of modules into the device shell.

3 Claims, 3 Drawing Sheets

(56) References Cited

U.S. PATENT DOCUMENTS

| | | | | |
|---|---|---|---|---|
| 2006/0097546 | A1 | 5/2006 | Lynam | |
| 2007/0246967 | A1 | 10/2007 | Lynam | |
| 2007/0267401 | A1 | 11/2007 | Collene | |
| 2008/0185372 | A1 | 8/2008 | Elkasevic | |
| 2008/0268330 | A1 | 10/2008 | Hansen | |
| 2009/0025432 | A1* | 1/2009 | Kim | D06F 34/34 68/12.27 |
| 2012/0255330 | A1* | 10/2012 | Wanweerakul | D06F 39/083 285/194 |
| 2014/0158676 | A1 | 6/2014 | Phillips | |
| 2017/0009391 | A1 | 1/2017 | Fu et al. | |
| 2018/0010287 | A1* | 1/2018 | Leisl, III | D06F 39/14 |
| 2018/0202665 | A1 | 7/2018 | Park | |
| 2019/0301072 | A1* | 10/2019 | Hoppe | D06F 29/00 |
| 2022/0018547 | A1 | 1/2022 | Degraaf | |

FOREIGN PATENT DOCUMENTS

| | | | |
|---|---|---|---|
| CN | 104711832 | | 6/2015 |
| CN | 108729117 | | 11/2018 |
| DE | 4139588 | | 6/1992 |
| EP | 0108460 | | 5/1984 |
| EP | 0899512 | | 3/1999 |
| EP | 0943721 | | 9/1999 |
| FR | 2748796 | | 11/1997 |
| KR | 100641433 | | 11/2006 |
| KR | 20130044609 | | 5/2013 |
| KR | 201300443609 | A * | 5/2013 |
| WO | 2004070278 | | 8/2004 |

OTHER PUBLICATIONS

Communication pursuant to Article 94(3) issued in App. No. EP20741950, dated Jan. 3, 2024, 7 pages.

International Preliminary Report on Patentability, dated Jul. 20, 2021 in PCT/US2020/014038.

Mekonnen Wassie Shimelis, "Modularization of a washing machine and study its potential in implementing multiple life-cycles", (Oct. 31, 2016), pp. 1-53, URL: https://www.diva-portal.org/smash/get/diva2:1071112/FULLTEXT01.pdf, (Jan. 26, 2022), XP055884033.

Extended European Search Report issued in App. No. EP22850216 dated Jun. 4, 2025, 12 pages.

* cited by examiner

APPARATUS, SYSTEM AND METHOD FOR MODULAR MANUFACTURE

CROSS-REFERENCE TO RELATED APPLICATIONS

The present application claims benefit to International Application No. PCT/US2020/014038, filed Jan. 17, 2020, entitled: Apparatus, System and Method for Modular Manufacture," which claims priority to U.S. Provisional Application No. 62/793,624, filed Jan. 17, 2019, entitled: "Apparatus, System and Method for Modular Manufacture," the entirety of which is incorporated herein by reference as if set forth in its entirety.

BACKGROUND

Field of the Disclosure

The present disclosure relates to manufacturing, and, more specifically, to an apparatus, system and method for modular manufacture.

Description of the Background

In presently known manufacturing operations, such as may be typical of large devices, such as appliances, ever increasing numbers of components and component related aspects are being added to the manufactured devices in order to provide functionality in line with modern expectations. For example, with the advent of the internet of things (IoT), it is often not only expected that modern devices have highly intuitive user interfaces, which additionally include broad applications and variation functions available via the user interface, but additionally that the device is capable of communication, such as simple communications wherein device errors are indicated, logged, and transmitted, or such as more complex communications. Both of these types of communication may occur over wireless connection, such as to or via home networks to brand centers, and the like. Moreover, it is expected that these increasingly capable devices not only provide the foregoing extensive functionality, but further that these devices operate more consistently and well, and last longer.

Unfortunately, the offering of ever increasing numbers of features, communicative aspects, and so on, along with preferences by manufacturers for increased production rate, yields, etc., such that manufacturer profitability be maintained, does not comport with typical device manufacturing technologies. Indeed, most devices are largely manufactured by hand, not dissimilarly to the way those devices were manufactured long before the availability of graphical user interfaces, device lighting, device communications, and the like.

For example, most devices include a plurality of wiring harnesses, each with numerous fasteners in various locations throughout a device, that transmit signals and power to and from a number of circuit boards, electrical elements, and the like (hereinafter, collectively "components"). In order to provide adequate space for the functional aspects of the device, it is typical that these numerous fasteners, wiring, components, and the like must be placed at awkward positions throughout the device. Thus, manual installation of all of these aspects may be awkward and difficult, and such installations are further highly repetitive and may require varying levels of strength, such as to make connections and fasten aspects. These variations may even occur as between the same components on different devices, in part due to engineering tolerances present in manufacturing the shell of a device.

The repetitive and time consuming nature of such installations of wiring, wiring harnesses, fasteners, and components within a device, at difficult angles and using varying strength, often leads to workplace injuries. Such manufacturing complexities and workplace injuries may slow production times, thereby increasing manufacturing cost.

Yet further, the manufacturing complexity discussed herein requires that substantial storage and floor space be dedicated to installation stages for in-process inventory, and to the aspects that must be installed into the in-process inventory. This need for storage and processing space further limits throughput in the manufacturing line.

More specifically, a typical manufacturing line in the known art requires that the device, such as the large appliance being manufactured, be transported from station to station to enable manual installation of unique components at each new station. As such, each station requires a specialized laborer who does repeated installations of the same or similar components over the course of a work period. Needless to say, at least the aforementioned throughput limitations imparted by in-process inventory limit the availability of device flow from station to station, and the repetitive aspects required of laborers create job dissatisfaction and repetitive work injuries, as mentioned above. Yet further, the foregoing aspects, in combination, decrease both throughput and yield, as discussed above.

SUMMARY

The disclosure is of and includes at least an apparatus, system and method for modular manufacturing. The apparatus, system and method may include at least a device shell capable of providing at least the structure of a manufactured device, wherein the device shell comprises a plurality of receivers; a plurality of modules, each comprising a plurality of components suitable, in combination, to provide functional aspects to the manufactured device; a plurality of connectors externally associated with each of the plurality of modules, wherein the plurality of connectors are capable of being respectively received by ones of the plurality of receivers to thereby fasten each of the plurality of modules into the device shell. Further included may be a plurality of electrical interfaces, each on an external portion of ones of the plurality of modules, wherein each external interface provides at least electrical connectivity from the plurality of components of a respective one of the plurality of modules off-board to other aspects of the manufactured device.

BRIEF DESCRIPTION OF THE DRAWINGS

The disclosed non-limiting embodiments are discussed in relation to the drawings appended hereto and forming part hereof, wherein like numerals indicate like elements, and in which.

DETAILED DESCRIPTION

Figure 1:
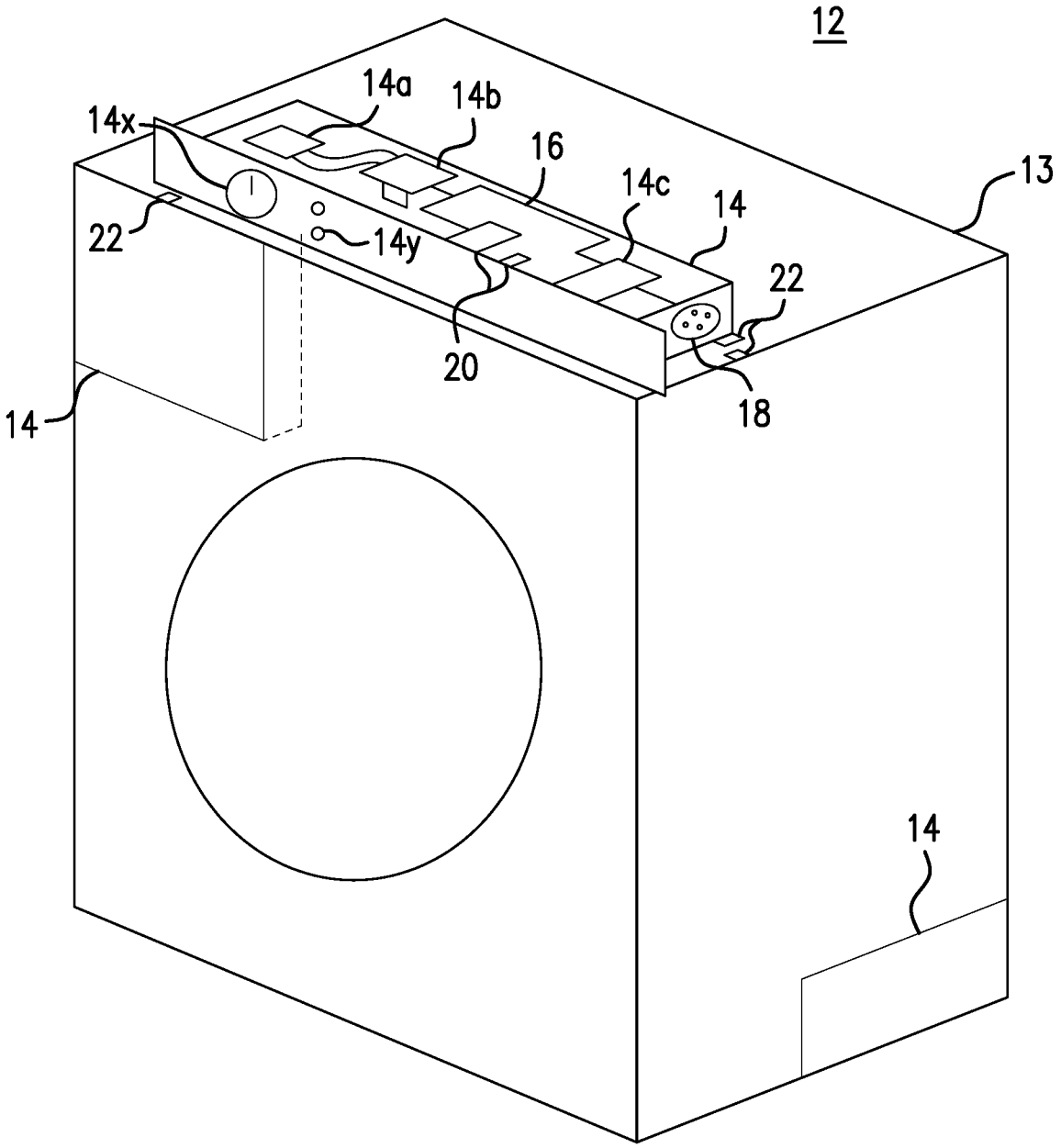
FIG. 1 is an illustration of a modular manufacture.

The figures and descriptions provided herein may have been simplified to illustrate aspects that are relevant for a clear understanding of the herein described apparatuses, systems, and methods, while eliminating, for the purpose of clarity, other aspects that may be found in typical similar devices, systems, and methods. Those of ordinary skill may thus recognize that other elements and/or operations may be desirable and/or necessary to implement the devices, systems, and methods described herein. But because such elements and operations are known in the art, and because they do not facilitate a better understanding of the present disclosure, for the sake of brevity a discussion of such elements and operations may not be provided herein. However, the present disclosure is deemed to nevertheless include all such elements, variations, and modifications to the described aspects that would be known to those of ordinary skill in the art.

Embodiments are provided throughout so that this disclosure is sufficiently thorough and fully conveys the scope of the disclosed embodiments to those who are skilled in the art. Numerous specific details are set forth, such as examples of specific components, devices, and methods, to provide a thorough understanding of embodiments of the present disclosure. Nevertheless, it will be apparent to those skilled in the art that certain specific disclosed details need not be employed, and that embodiments may be embodied in different forms. As such, the embodiments should not be construed to limit the scope of the disclosure. As referenced above, in some embodiments, well-known processes, well-known device structures, and well-known technologies may not be described in detail.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The steps, processes, and operations described herein are not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

When an element or layer is referred to as being "on", "engaged to", "connected to" or "coupled to" another element or layer, it may be directly on, engaged, connected or coupled to the other element or layer, or intervening elements or layers may be present, unless clearly indicated otherwise. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). Further, as used herein the term "and/or" includes any and all combinations of one or more of the associated listed items.

Yet further, although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the embodiments.

The embodiments provide a methodology whereby assembly time may be decreased for manufacturer of certain devices, such as large appliances, by a factor of ten or more over the known art. More particularly, the embodiments include the prefabrication, such as in the form of snap-in, screw-in or clip-in modules, of discrete portions or discrete device subsystems that may be common across all devices in certain locations in the device, for simplistic inclusion into the device during manufacture. The modular subsystem(s) may snap entirely onto one, or more than one, internal supports or fasteners already within the device shell.

Accordingly, one or more aspects of device manufacture may be automated, such as allowing for the use of robotics; minor variances between devices may be largely eliminated; and manufacturing throughput and yield may be increased. Advantageously, the foregoing allows for the modules to independently, discretely and conveniently provided to a manufacturing line. Moreover, the manufacturing line, at least due to the elimination of large variations in available throughput as occurs in the known art, may generate and store much of the necessary modular inventory offsite. Needless to say, quality control and inspection of the devices may also thus largely occur offsite, as the individual modules may be inspected for quality outside of the manufacturing line. This, of course, further enhances manufacturing throughput.

It will be appreciated that each of the foregoing aspects enhances throughput and yield as stated above. Further, it will be understood that the skilled artisan that repetitive motion injuries, cut injuries, other injuries, and job satisfaction may further be substantially addressed by the disclosed embodiments.

FIG. 1 illustrates a device 12 comprised of a plurality of snap in modules 14 during manufacture 10 of the device 12, which includes at least the device shell 13 suitable to receive module(s) 14. It should be noted that, although the device 12 illustrated is a washing machine, the embodiment of FIG. 1 is provided by way of example only, and any large device or appliance having a plurality of subsystems may make use of the disclosed embodiments.

Each of the modules 14 illustrated in FIG. 1 may include numerous components 14*a, b, c* . . . brought together in the module 14. Further, each module 14 may include connectivity 16, 18 between components 14*a, b* . . . , and to external elements of the device, as needed, along with mounts 20 for the components 14*a, b* . . . to securely retain each component in its proper position within module 14, as well as external mounts 22 for the overall module 14 to be place into the device 12 during manufacture, also as needed.

Components may include, but are not limited to, appliance, such as washer or dryer, or automotive, components. By way of example, a module 14 may include components of a front or rear header of a washer or dryer, such as a human-machine interface (HMI), control unit(s), wireharness(es), valves, hoses, stamped components, and so on. Accordingly, modules 14 may be mechanical, electrical, or electro-mechanical, either independently or in combinations thereof.

As shown, certain of the modules 14 may include not only internal components 14*a, b* . . . in order to provide operability to the module 14, but further may include external components 14*x, y, z* . . . such as dials, button, lights, and so on. Using the device mounts 22 discussed above, each module 14 may be placed, manually or automatically, during the manufacturing process, at its proper location in the device 12, at which the securing mounts/fasteners 22 for that module 14 may be fastened into the device 12 to allow for operability of internal components 14*a, b* . . . and external components 14*x, y* . . . , as discussed throughout.

It would be understood that the manufacture of the device 12 in accordance with the illustration of FIG. 1 may free up floor space and limit storage needs in the manufacturing line 30, in the warehouse, in onsite storage, and so on, to thus enable more units to ship and with improved quality control. By way of example, quality control 36 may be implemented at the formation site for each module 14, such that quality control 42 in the manufacturing line may be minimized, or quality control 42 in the manufacturing may simply provide redundancy with the quality control 36 done offsite, thereby improving yield, throughput, and product performance of the manufacturing line 30. Needless to say, the foregoing may also decrease cost to the manufacturing center, such as by minimizing inventory, decreasing inspection needs, decreasing labor needs, improving onsite logistics, and so on.

Figure 2:
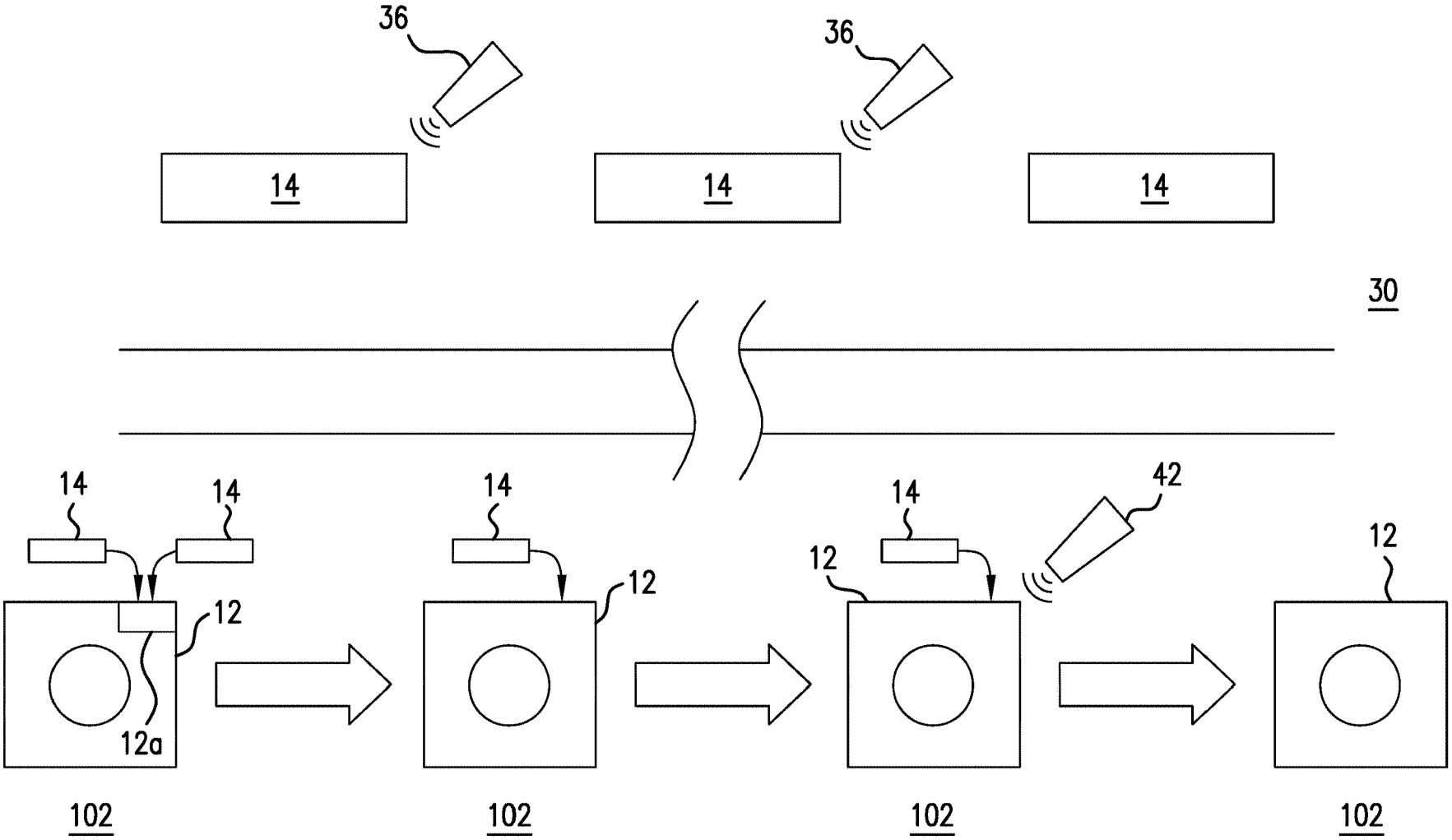
FIG. 2 is an illustration of a manufacturing system.

As illustrated in FIG. 2, the providing of a plurality of snap in modules 14 may further decrease the number of stations 102 necessary in a manufacturing line 30. For example, rather than a manufacturing employee 104 working on only one aspect of the device 12 before the device 12 is passed to the next station 102, each station 102 may allow for the installation of one or multiple snap-in modules 14, such as wherein all snap in modules 14 in a particular portion of the device 12*a* are ergonomically installed at a single manufacturing station 102.

By providing the disclosed snap in modules, and such as in any embodiments wherein one or more modules in a particular aspect of the device are substantially simultaneously installed at a single station, station ergonomics may be improved as referenced above. By way of example, the need for an unnatural angle for installation of an aspect may be largely eliminated in the embodiments, because modules may be formed particularly to follow angles of a device shell for installation, and/or may be automatically installed. Further, the attachment of the module within the device may be readily rotatable and munipulatable to comply with principles of z axis and/or neutral plan manufacturing, thereby improving employee health and return on investment.

Moreover, as the attachment of the many components within the module is performed outside of the manufacturer line, the number of aspects in need of attachment to the device during manufacturer is greatly minimized. That is, in embodiments where 20 components were necessary for attachment individually across multiple stations in the manufacturing line in the known art, the embodiments may provide a single module inclusive of all 20 components, thereby requiring the attachment of only a single component, i.e. the module, at a single station in the manufacturing line. Further, each module may be designed to more readily allow access to components, such as for replacement of low yield or faulty components, or for later replacement of use-failed components, due to the design of the module independently from the design of the overall device.

Further, and as referenced above, the integration of modules into a manufacturing system allows for improved correction of defects over the known art. Indeed, quality control at the module formation site allows for the correction of most defects prior to arrival of the module at the manufacturer's facility. Accordingly, the embodiments may significantly improve manufacturing line yield over the known art. That is, in the known art, even the least stringent of quality control systems generally performs quality control at at least several stations during the manufacturing line, and additional testing at the end of device production. Needless to say, this enhances the likelihood that defects will enter the manufacturing process, such as between inspection stations or in the overall operations across a variety of stations each performing their respective functionality.

Figure 3:
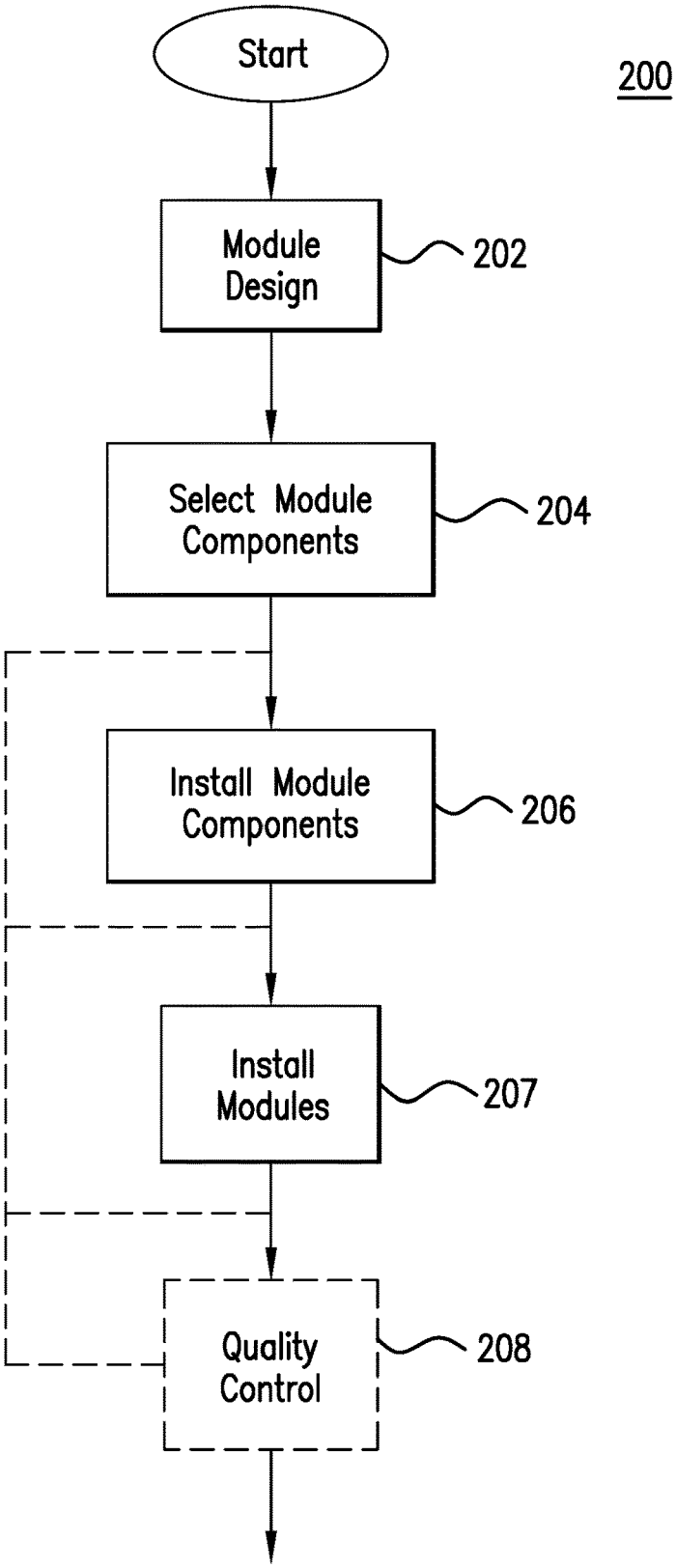
FIG. 3 illustrates a manufacturing method.

FIG. 3 illustrates a flow diagram of a method 200 according to aspects of the embodiments. As illustrated, a plurality of modules is designed to perform, often in conjunction with other modules, functionality provided by a device, at step 202. Further, each of these modules is designed to be located within that device, such as within at least internal portions of the device, and/or, at times, with external portions of the device, at step 202.

At the next step 204, a variety of components necessary to perform the functionality of a given module are selected for placement on the module. Each of these components may thus be provided with a fastener, a location, and any other aspect necessary to perform the functionality and/or fastening of the component within the module, such as wiring, connective traces, soldering, and the like. These components are then placed, fastened, physically and/or electrically connected, at their respective locations on the module, at step 206. The module is thus provided with external fasteners to ultimately allow for placement of the module into the device and/or interconnection with other modules at step 206.

Each module is preferably placed into the overall device at its designed/designated location. This placement into the overall device at step 207 may be done manually, robotically, or in combinations thereof, by way of non-limiting example.

Yet further, the method discussed above with respect to FIG. 3 may additionally include optional steps 208 for quality control inspection, such as upon placement of one or more components into the module, placement of the module into the device, placement of other modules in the device in conjunction with the module, or upon completion of production for the final device. Needless to say, based on the present disclosure, aspects of this step 208 may be performed in different locations, such as at the module generator and at the manufacturer.

Needless to say, and as discussed throughout, aspects of each module may include known features that allow for interoperability of modules with the overall device. Such features may include, by way of example, proprietary or publicly available electrical connectors, exterior wiring, insulation, bumpers, knobs, adjustments, and so on.

It is appreciated that any exemplary computing, processing and control is merely illustrative of a computing which may be used in the herein described systems and methods, and does not limit the implementation of the herein described systems and methods from having differing components and configurations. That is to say, the concepts described herein may be implemented in any of various environments using various components and configurations.

In the foregoing detailed description, it may be that various features are grouped together in individual embodiments for the purpose of brevity in the disclosure. This method of disclosure is not to be interpreted as reflecting an intention that any subsequently claimed embodiments require more features than are expressly recited.

Further, the descriptions of the disclosure are provided to enable any person skilled in the art to make or use the disclosed embodiments. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but rather is to be accorded the widest scope consistent with the principles and novel features disclosed herein.

What is claimed is:

1. A system of manufacturing, comprising:

an assembly line comprising a plurality of assembly stations; and a manufactured device having a plurality of modules installed during robotic assembly at a single assembly station of the plurality of assembly stations, the manufactured device comprising:

a device shell capable of providing at least the structure of the manufactured device, wherein the device shell comprises a plurality of receivers;

the plurality of modules, each comprising a plurality of components suitable, in combination, to provide functional aspects to the manufactured device, wherein at least one module of the plurality of modules comprises a plurality of internal components and external components suitable, in combination, to provide operability to the at least one module, wherein the plurality of internal components of the at least one module are positioned within the device shell, and wherein the plurality of external components of the at least one module are positioned outside the device shell;

a plurality of connectors externally associated with each of the plurality of modules, wherein a portion of the plurality of connectors are capable of being respectively received by ones of the plurality of receivers to thereby fasten each of the plurality of modules into the device shell, and wherein another portion of the plurality of connectors are capable of fastening one module to another module; and a plurality of electrical connectors, each on an external portion of ones of the plurality of modules to provide an electrical connection from the plurality of components of a respective one of the plurality of modules off-board to other aspects of the manufactured device.

2. The system of claim 1, wherein the plurality of modules is preassembled with the respective plurality of components prior to being provided to the single assembly station.

3. The system of claim 1, wherein a shape of a module is formed to follow angles of the device shell.

* * * * *